US006737848B2

(12) United States Patent
Goetz et al.

(10) Patent No.: US 6,737,848 B2
(45) Date of Patent: May 18, 2004

(54) REFERENCE VOLTAGE SOURCE

(75) Inventors: Laszlo Goetz, Freising (DE); Stefan Reithmaier, Vilsheim (DE); Kevin Scoones, Munich (DE)

(73) Assignee: Texas Instruments Incorporated, Dallas, TX (US)

( * ) Notice: Subject to any disclaimer, the term of this patent is extended or adjusted under 35 U.S.C. 154(b) by 16 days.

(21) Appl. No.: 10/294,120

(22) Filed: Nov. 14, 2002

(65) Prior Publication Data

US 2003/0107361 A1 Jun. 12, 2003

(30) Foreign Application Priority Data

Nov. 15, 2001 (DE) ..... 101 56 048

(51) Int. Cl.[7] ..... G05F 3/16
(52) U.S. Cl. ..... 323/313
(58) Field of Search ..... 323/311, 312, 323/313; 327/378, 512, 513

(56) References Cited

U.S. PATENT DOCUMENTS 5,013,999 A * 5/1991 Yamada ..... 323/313
5,450,004 A * 9/1995 Ikeda ..... 323/313

* cited by examiner

*Primary Examiner*—Michael Sherry
*Assistant Examiner*—Gary L. Laxton
(74) *Attorney, Agent, or Firm*—Warren L. Franz; W. James Brady; Frederick J. Telecky, Jr.

(57) ABSTRACT

The invention relates to a reference voltage source including a bipolar transistor having a base, a collector and an emitter electrode. The reference voltage source further comprises a Schottky diode (D) whose anode is connected to the base electrode of the bipolar transistor and whose cathode is connected to the collector electrode of the bipolar transistor. The currents flowing through the Schottky diode and bipolar transistor are each set so that a temperature-independent reference voltage (VREF) materializes at the collector electrode of the bipolar transistor.

2 Claims, 1 Drawing Sheet

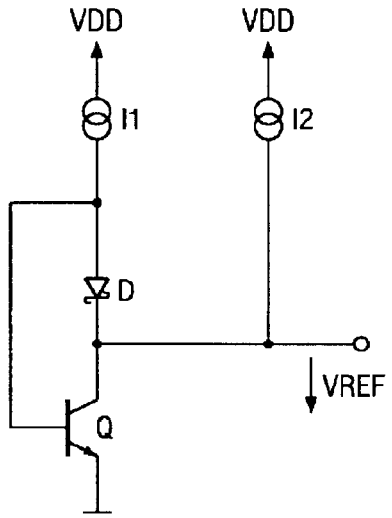
FIG. 1
FIG. 2
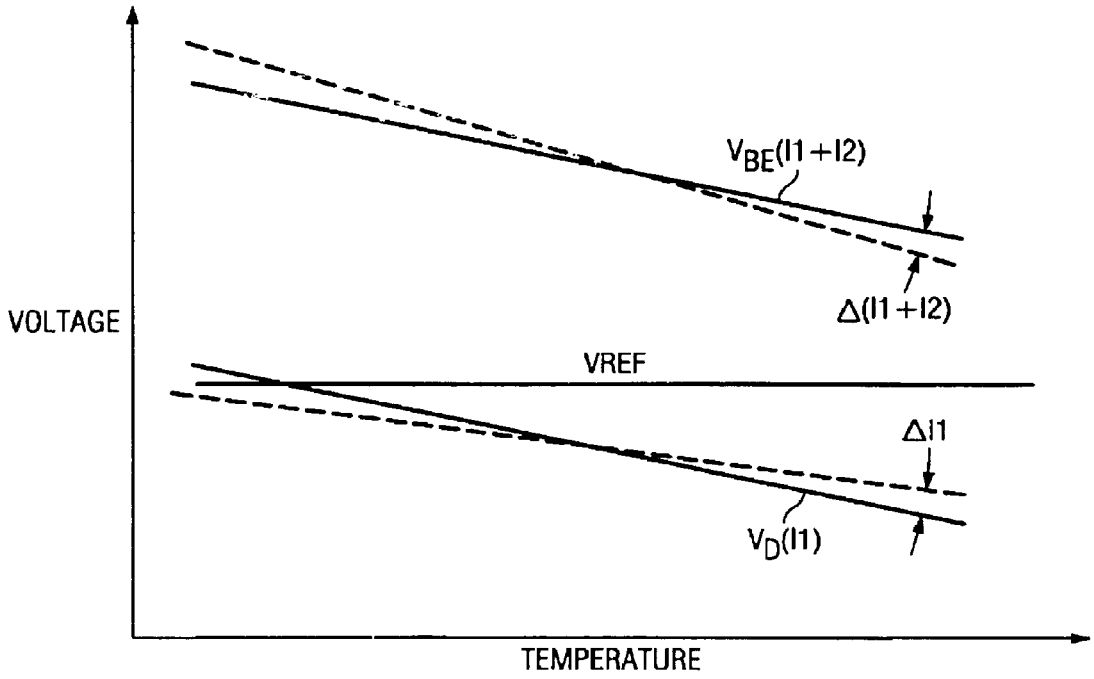

REFERENCE VOLTAGE SOURCE

This application claims priority under 35 U.S.C. 119 of German Patent Application Number 10156048.6 filed Nov. 15, 2001.

FIELD OF THE INVENTION

The invention relates to a reference voltage source including a bipolar transistor having a base, a collector and an emitter electrode.

BACKGROUND OF THE INVENTION

One such reference voltage source is known from the German semiconductor circuitry textbook, "Halbleiter-Schaltungstechnik" by O. Tietze and Ch. Schenk, published by Springer-Verlag, 9th Edition, pages 558 et seq. In this known reference voltage source the base-emitter voltage of a bipolar transistor is used as the voltage reference. The temperature coefficient of this voltage of −2 mV/Kelvin is remarkably high for a voltage value of 0.6 V. Compensating this temperature coefficient is achieved by adding a temperature coefficient of +2 mV/Kelvin generated by a second transistor. It can be shown that by operating the two transistors with different current densities a highly accurate reference voltage of 1.205 V can be achieved, exhibiting no dependency on temperature.

In this known reference voltage source each of the two transistors is in a separate branch of the circuit. The currents flowing in the two circuit branches are set so that the sum voltage has the desired temperature coefficient. The voltage follower stage is formed by an operational amplifier generating the reference voltage at its output. The output voltage of the operational amplifier is, in addition, fed back to the base terminals of the two transistors.

Since in reference voltage sources of the aforementioned kind two circuit branches are needed to generate the reference voltage, such reference voltage sources require a feedback/combination stage. This makes such circuits relatively complicated. They necessitate more components and have a higher current consumption. A further disadvantage is that a relatively high supply voltage is needed which needs to attain at least the band gap voltage of the semiconductor employed, this being at least 1.2 V for silicon as the material used as a rule.

The invention is thus based on the objective of providing a reference voltage source of the aforementioned kind in which for generating the reference voltage only a single circuit branch is needed and which, in addition, can be operated with smaller supply voltages than circuits hitherto in thus featuring a lower current consumption.

In accordance with the invention this objective is achieved by a reference voltage source of the aforementioned kind including a bipolar transistor which is characterized by it further comprising a Schottky diode whose anode is connected to the base electrode of the bipolar transistor and whose cathode is connected to the collector electrode of the bipolar transistor, the currents flowing through the Schottky diode and the collector-emitter circuit of the bipolar transistor each being set so that a temperature-independent reference voltage (VREF) materializes at the collector electrode of the bipolar transistor.

The reference voltage source in accordance with the invention has the advantage of requiring fewer components whilst having a lower current consumption.

BRIEF DESCRIPTION OF THE DRAWINGS

The invention will now be detailed by way of an example embodiment with reference to the drawings in which:

FIG. 1 is a circuit diagram of an example embodiment of the reference voltage source in accordance with the invention and FIG. 2 is voltage/temperature graph assisting explaining the principle of generating the reference voltage in accordance with the invention.

Referring now to FIG. 1 there is illustrated the reference voltage source in accordance with the invention containing as its main components an npn bipolar transistor Q and a Schottky diode D. The bipolar transistor Q and the Schottky diode D are connected in series so that the cathode terminal of the Schottky diode D is connected to the collector electrode of the bipolar transistor Q. In addition, the base electrode of the bipolar transistor Q is connected to the anode terminal of the Schottky diode D. The emitter electrode of the bipolar transistor Q is connected to ground. The diode D and transistor Q are located in a first branch of the circuit in which a first current I1 flows from the side of the diode D, this current being set by a first current source. A second branch connected in parallel to the first branch of the circuit conducts a second current I2 which is set by a second current source. An output furnishing the reference voltage is connected to a junction connected to the cathode of the Schottky diode D and collector electrode of the bipolar transistor Q. Porting, in addition, into this connection is the second branch of the circuit.

DETAILED DESCRIPTION OF EMBODIMENTS OF THE INVENTION

The invention makes use of the fact that the forward voltage VD of a Schottky diode and the base-emitter voltage VBE of a bipolar transistor have the same temperature dependency when the current densities are suitably selected. Referring now to FIG. 2 there is illustrated how this is to be understood. By tuning the currents I1 and I2 accordingly, the slopes of VD (I1) and VBE (I1+I2) are set so that VD and VBE are parallel to each other and their difference gives the temperature-independent reference voltage VREF, whereby VD is the voltage at the Schottky diode and VBE is the base-emitter voltage of the bipolar transistor.

Thus, when setting the currents I1 and I2 to each other so that for the current densities in the Schottky diode D and bipolar transistor Q values materialize in which the temperature coefficients for the two components are the same, then by subtracting the forward voltage VD of the Schottky diode D from the base-emitter voltage VBE of the bipolar transistor Q a reference voltage VREF is obtained independent of temperature.

The current I1 dictates the temperature coefficient of the forward voltage VD of the Schottky diode D and can be set to a very small value. The current I2 serves to set the temperature coefficient of the bipolar transistor Q. For the arrangement forming the basis of the circuit as described herein a supply voltage equaling the base-emitter voltage VBE is sufficient.

This now makes it possible to achieve a reference voltage source by simple means which furnishes a low voltage independent of temperature for a low current consumption.

Correspondingly, it would be just as possible to achieve a reference voltage source making use of a pnp bipolar transistor instead of an npn bipolar transistor.

The voltage furnished by the supply voltage source of the circuit in accordance with the invention merely needs to correspond to the value of the required base-emitter voltage of the transistor and may thus amount to only approx. 0.7 V for silicon. This now makes it possible to achieve a substantially lower energy consumption as compared to conventional band gap references whose supply voltage sources need to work at least 1.2 V.

What is claimed is:

1. A reference voltage source including a bipolar transistor (Q) having a base, a collector and an emitter electrode, characterized by it further comprising a Schottky diode (D) whose anode is connected to the base electrode of said bipolar transistor and whose cathode is connected to the collector electrode of said bipolar transistor, the currents (I1, I1+I2) flowing through said Schottky diode (D) and the collector-emitter circuit of said bipolar transistor (Q) each being set so that a temperature-independent reference voltage (VREF) materializes at the collector electrode of said bipolar transistor.

2. The reference voltage source as set forth in claim 1 wherein a first current source is provided which is connected to the anode of said Schottky diode (D) and defines the current (I1) through said Schottky diode, and a second current source is provided which is connected to the cathode of said Schottky diode and the collector of said transistor, the sum of the currents (I1+I2) furnished by said first current source and said second current source defining the current through the collector-emitter circuit of said bipolar transistor.

* * * * *